US005564478A

United States Patent [19]

Weinheimer et al.

[11] Patent Number: 5,564,478

[45] Date of Patent: Oct. 15, 1996

[54] HEAT SEALABLE INFLATOR

[75] Inventors: Jacek M. Weinheimer, Treasure Island; Lyman W. Fawcett, Jr., St. Petersburg, both of Fla.

[73] Assignee: Halkey-Roberts Corporation, St. Petersburg, Fla.

[21] Appl. No.: 300,491

[22] Filed: Sep. 2, 1994

[51] Int. Cl.[6] ..... B67B 7/46

[52] U.S. Cl. ..... 141/19; 141/3; 141/330; 141/197; 222/5

[58] Field of Search ..... 141/3, 19, 329, 141/330, 197; 222/5; 441/41, 94

[56] References Cited

U.S. PATENT DOCUMENTS

| | | | |
|---|---|---|---|
| 2,730,093 | 1/1956 | Neely | 141/19 X |
| 2,786,599 | 3/1957 | Higbee | 222/5 |
| 3,072,157 | 1/1963 | Iketani | 141/19 X |
| 3,796,181 | 3/1974 | Collins | 222/5 X |
| 3,809,288 | 5/1974 | Mackal | 222/5 |
| 3,997,079 | 12/1976 | Niemann | 222/5 |
| 4,805,802 | 2/1989 | MacKendrick et al. | 222/5 |
| 5,329,975 | 7/1994 | Heitel | 141/19 |

*Primary Examiner*—J. Casimer Jacyna
*Attorney, Agent, or Firm*—Dominik & Stein

[57] ABSTRACT

An inflator adapted to be heat-sealed directly to an inflatable article thereby obviating the need for inflation manifolds and the like. The inflator of the invention comprises a housing having an integrally formed mounting flange composed of a plastic material such as polyurethane, polyester or polyether capable of being easily sealed to the materials conventionally used in the manufacture of inflatable articles such as personal floatation devices, rafts, buoys and emergency signaling equipment. A pierce pin assembly is reciprocatably mounted within a bore in the housing. A firing lever is pivotably connected to the rear of the housing in alignment with the rearward end of the bore and is operatively configured such that upon pivotable movement by means of a lanyarded ball, the pierce pin assembly is forced forwardly within the bore to pierce the frangible seal of the gas cartridge. Upon piercing, the gas in the gas cartridge escapes into the bore and then into the inflatable article via a port formed within the housing from the bore to the exterior of the housing at a position located interially of the inflatable article, thereby inflating the inflatable article.

14 Claims, 7 Drawing Sheets

HEAT SEALABLE INFLATOR

BACKGROUND OF THE INVENTION

1. Field of the Invention

This invention relates to an inflator for inflating articles such as personal floatation devices, rafts, buoys, and emergency signalling equipment. More particularly, this invention relates to inflators whose housings may be directly heat-sealed to the inflatable article while assuring that the inflatable article remains inflated even when the gas cartridge of the inflator is removed.

2. Description of the Background Art

Presently, there exists many types of inflators designed to inflate inflatable articles such as personal floatation devices (life vests, rings and horseshoes), life rafts, buoys and emergency signalling equipment. Inflators typically comprise a body for receiving the neck of a cartridge of compressed gas such as carbon dioxide. A reciprocating pierce pin is disposed within the body of the inflator for piercing frangible seal of the cartridge to permit compressed gas therein to flow into a manifold assembly of the inflator and then into the article to be inflated. Typically, a manually movable firing lever is operatively connected to the piercing pin such that the piercing pin pierces the frangible seal of the cartridge upon jerking of a ball lanyard. U.S. Pat. No. 3,809,288, the disclosure of which is hereby incorporated by reference herein, illustrates one particular embodiment of a manual inflator.

Water-activated actuators have been incorporated into manual inflators so that in an emergency situation such as downed aviator, injured person or a man overboard, the inflator is automatically actuated to inflate the inflatable article to which it is connected. Representative automatic actuators for inflators are disclosed in U.S. Pat. Nos. 3,059,814, 3,091,782, 3,426,942, 3,579,964, 3,702,014, 3,757,371, 3,910,457, 3,997,079, 4,223,805, 4,267,944, 4,260,075, 4,382,231, 4,436,159, 4,513,248, 4,627,823, and 5,076,468, the disclosures of which are hereby incorporated by reference herein.

As disclosed in the above-referenced patents, inflators, whether manually or water-activated, are typically connected to the inflatable article by means of the manifold assembly that consists of a metal manifold having a lower flange which is molded in situ with a rubber flange. A one-way valve, such as a schraeder valve, is installed in the manifold. During installation, a hole is formed in the inflatable article and the manifold is positioned therethrough. The flange of the manifold assembly is then heat-sealed to the wall of the inflatable article. Notably, the one-way valve in the manifold permits inflation of the inflatable article while precluding deflation once inflated. Representative patents relating to manifold assemblies are U.S. Pat. Nos. 5,080,402, 5,058,933, 5,058,932, 4,216,182, 3,809,288 and 3,754,731, the disclosures of which are hereby incorporated by reference herein.

Correspondingly, typical inflators comprise a manifold hole which is configured and dimensioned to receive the manifold of the manifold assembly. A locking nut is threaded onto the end of the manifold to secure the inflator. An O-ring seal is provided to prevent leakage between the manifold and the inflator.

During use, upon firing of the inflator, either manually or automatically, gas from the compressed gas cartridge flows into the manifold hole of the inflator and then into the manifold. The gas then flows past the one-way valve in the manifold and into the inflatable article. Since the one-way valve of the manifold assembly precludes deflation of the inflatable article, the gas cartridge may be removed from the inflator and the inflatable article will remain inflated.

While manifold assemblies have been in extensive use in the industry for many years, they are relatively expensive to manufacture and require additional assembly operations. Accordingly, there is a need in the inflator industry for an inflator which may be heat-sealed directly to the inflatable article thereby obviating the need for manifold assemblies and the like.

U.S. Pat. No. 4,894,036, the disclosure of which is hereby incorporated by reference herein, discloses an inflator which may be heat-sealed directly to an inflatable article thereby obviating the need for manifold assemblies and the like. The heat-sealable inflator as shown in such patent includes a mounting flange integrally formed about the housing of the inflator. The housing together with the integral mounting flange are composed of a plastic or similar material which may be heat-sealed to inflatable articles composed of conventional plastic or other materials. The housing includes a reciprocal pierce pin and a firing lever. A pair of compression springs are provided at opposing ends of the pierce pin to exert forces thereon in opposite directions. A pair of O-rings are also provided at opposing ends of the pierce pin. During firing upon jerking of the manual firing lever, the cammed end thereof exerts a force on the rearward (stronger) spring and causes the pierce pin to move forwardly and pierce the gas cartridge. The cammed end of the manual firing lever is configured such that upon further movement of the lever, the pierce pin may be blown-back fully rearwardly by means of the forward (weaker) compression spring combined with the pressure exerted by the gas from the gas cartridge. The bore of the housing in which the pierce pin is reciprocatably positioned is configured in such a manner that when the pierce pin is blown-back fully rearwardly, the gas may flow through a port into the inflatable article. However, once the gas has escaped from the gas cartridge into the inflatable article, the lost pressure allows the rearward (stronger) spring to return the pierce pin assembly to its rest position. The bore of the housing is configured so that when the pierce pin is in its rest position, the O-rings seal the port both forwardly and rearwardly in the bore thereby precluding the gas from the inflatable article from escaping.

Unfortunately, the specific design of the heat-sealable inflator as shown in U.S. Pat. No. 4,894,036 is expensive to manufacture due to the necessity of dual springs and its other components. Moreover, it appears that the specific design could undesirably prevent inflation if the firing lever was only moved partially through its path of travel (see FIG. 5 thereof).

Therefore, it is an object of this invention to provide an improvement which overcomes the aforementioned inadequacies of the prior art devices and provides an improvement which is a significant contribution to the advancement of the inflation art.

Another object of this invention is to provide a heat-sealable inflator for inflatable articles having a housing with a mounting flange integral thereto, the housing and the flange being composed of a material that is capable of being easily sealed to the type of materials that are typically utilized in the construction of inflatable articles.

Another object of this invention is to provide a heat-sealable inflator which utilizes a minimal number of components and is therefore economical to manufacture.

Another object of this invention is to provide a heat-sealable inflator having a design which precludes deflation of the inflatable article once inflated even if the gas cartridge threaded into the housing is removed.

Another object of this invention is to provide a heat-sealable inflator having a design which eliminates a condition of non-inflation even if the firing lever thereof does not move through its full path of travel.

Another object of this invention is to provide a heat-sealable inflator for inflating an inflatable article with gas from a gas cartridge, comprising in combination: an inflator housing including a bore; means at one end of the bore for receiving the gas cartridge; a pierce pin assembly which is reciprocatably positioned within the bore; means at another end of the bore for actuating the pierce pin assembly to allow gas from the gas cartridge to flow into the bore; means for fluidly connecting the bore to the inflatable article to allow the gas to inflate the inflatable article; and the pierce pin assembly comprising rear seal means for sealing a rearward portion of the bore and a slidable seal assembly means capable, during inflation of the inflatable article, of being blown-back by the pressure of the gas from the gas cartridge and, after inflation, forming a seal with a forward portion of the bore to prevent the gas in the inflatable article from escaping therefrom forwardly through the bore.

Another object of this invention is to provide a method for inflating an inflatable article with gas from a gas cartridge, comprising the steps of: providing an inflator housing including a bore; receiving the gas cartridge at one end of the bore; reciprocatably positioning a pierce pin assembly within the bore; actuating the pierce pin assembly to allow gas from the gas cartridge to flow into the bore; fluidly connecting the bore to the inflatable article to allow the gas to inflate the inflatable article; and sealing a rearward portion of the bore and, after inflation, forming a seal with a forward portion of the bore to prevent the gas in the inflatable article from escaping therefrom forwardly through the bore.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an inflator adapted to be heat-sealed directly to an inflatable article thereby obviating the need for inflation manifolds and the like. More particularly, the inflator of the invention comprises a housing having an integrally formed mounting flange. The housing and the mounting flange are formed by injection molding or the like and are composed of a plastic material such as polyurethane, polyester or polyether capable of being easily sealed to the materials conventionally used in the manufacture of inflatable articles such as personal floatation devices, rafts, buoys and emergency signalling equipment.

A pierce pin assembly is reciprocatably mounted within a bore in the housing. A firing lever is pivotably connected to the rear of the housing in alignment with the rearward end of the bore. A threaded metal insert for receiving a conventional gas cartridge is molded in situ within the forward end of the bore. The firing lever is operatively configured such that upon pivotable movement by means of a lanyarded ball, the pierce pin assembly is forced forwardly within the bore to pierce the frangible seal of the gas cartridge threaded into the metal insert. Upon piercing, the gas in the gas cartridge escapes into the bore and then into the inflatable article via a port formed within the housing from the bore to the exterior of the housing at a position located interially of the inflatable article, thereby inflating the inflatable article.

An important feature of the present invention is the pierce pin assembly which is configured in such a manner that it precludes escaping of the gas from the gas cartridge from the bore during inflation thereby causing all of the gas to flow into the inflatable article via the port. The configuration of the pierce pin assembly additionally functions to seal that portion of the bore forwardly of the port after the gas escapes from the gas cartridge into the inflatable article. The gas contained within the inflatable article is therefore precluded from escaping from the inflator even if the gas cartridge is removed after inflation.

Therefore, it can be readily appreciated that the particular configuration of the pierce pin assembly of the invention functions as a one-way valve permitting inflation of the inflatable article and precluding deflation thereof once inflated. Importantly, the pierce pin assembly of the invention utilizes a single compression spring in combination with a conventional O-ring positioned about its rearward portion and novel sliding seal assembly positioned about the pierce pin at its forward portion. The sliding seal assembly functions as a check valve to permit inflation of the inflatable article and to preclude deflation once inflated. The sliding seal assembly may comprise several embodiments without departing from the spirit and scope of this invention.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
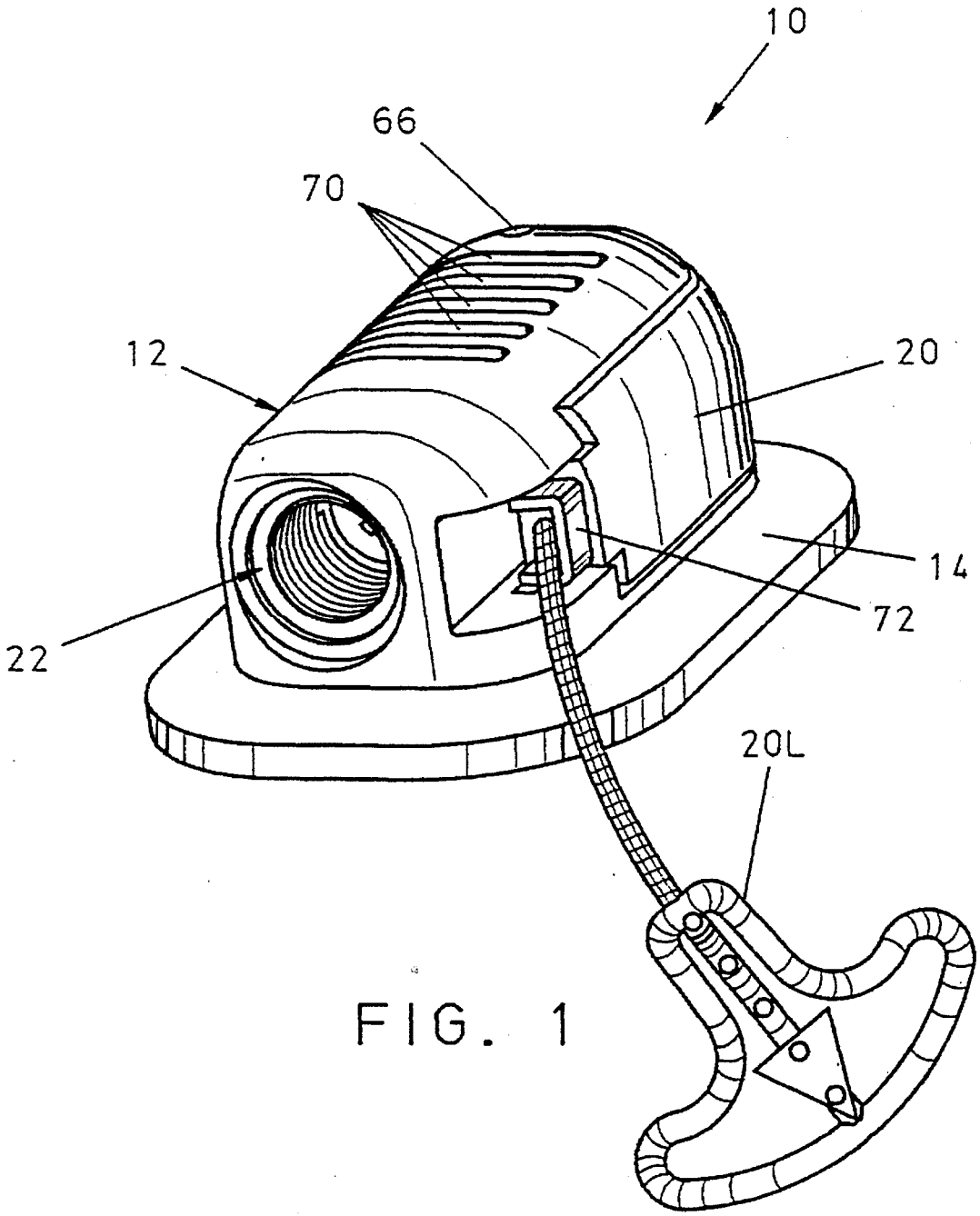
FIG. 1 is a forward perspective view of the inflator of the invention illustrating the metal insert molded in situ within the forward portion of the housing for receiving a conventional gas cartridge and illustrating the firing lever of the invention having a lanyarded ball secured thereto.
Figure 2:
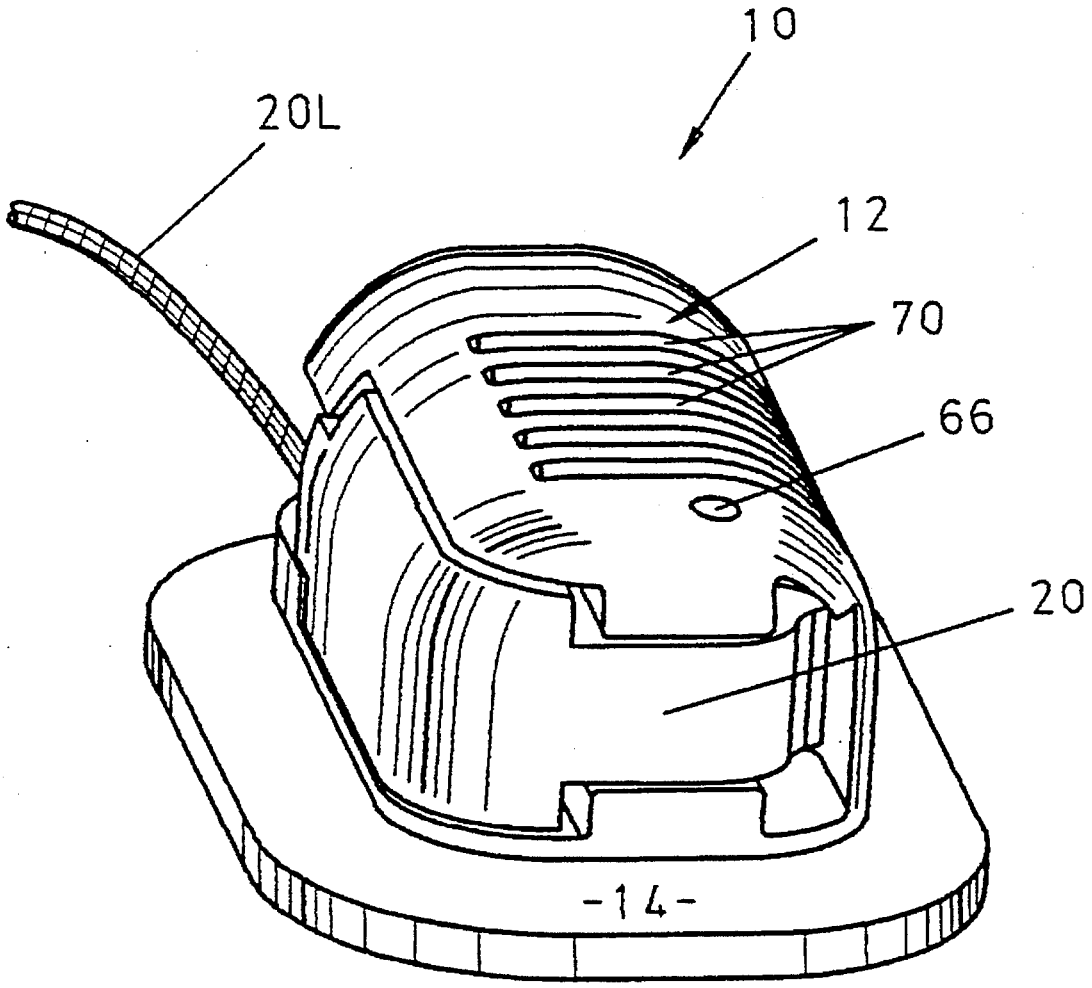
FIG. 2 is a rearward perspective view of the inflator of the invention illustrating the pivot pin which pivotably secures the firing lever in the rearward portion of the inflator housing in alignment with the pierce pin assembly reciprocatably mounted therein.

As shown in FIGS. 1 and 2, the inflator 10 of the invention comprises a generally rectangular-shaped inflator housing 12 having a mounting flange 14 formed annularly about one side thereof. Preferably, the housing 12 and its mounting flange 14 are integrally formed together of a material that is capable of being readily sealed with the material of an inflatable article. Most preferably, the material constituting the housing 12 and the flange 14 comprises a material such as polyurethane, polyester or polyether, each of which are known to be readily sealable, such as by radio frequency sealing, to materials conventionally used in the manufacture of inflatable articles such as personal floatation devices, life rafts, buoys and emergency signalling equipment.

Figure 3:
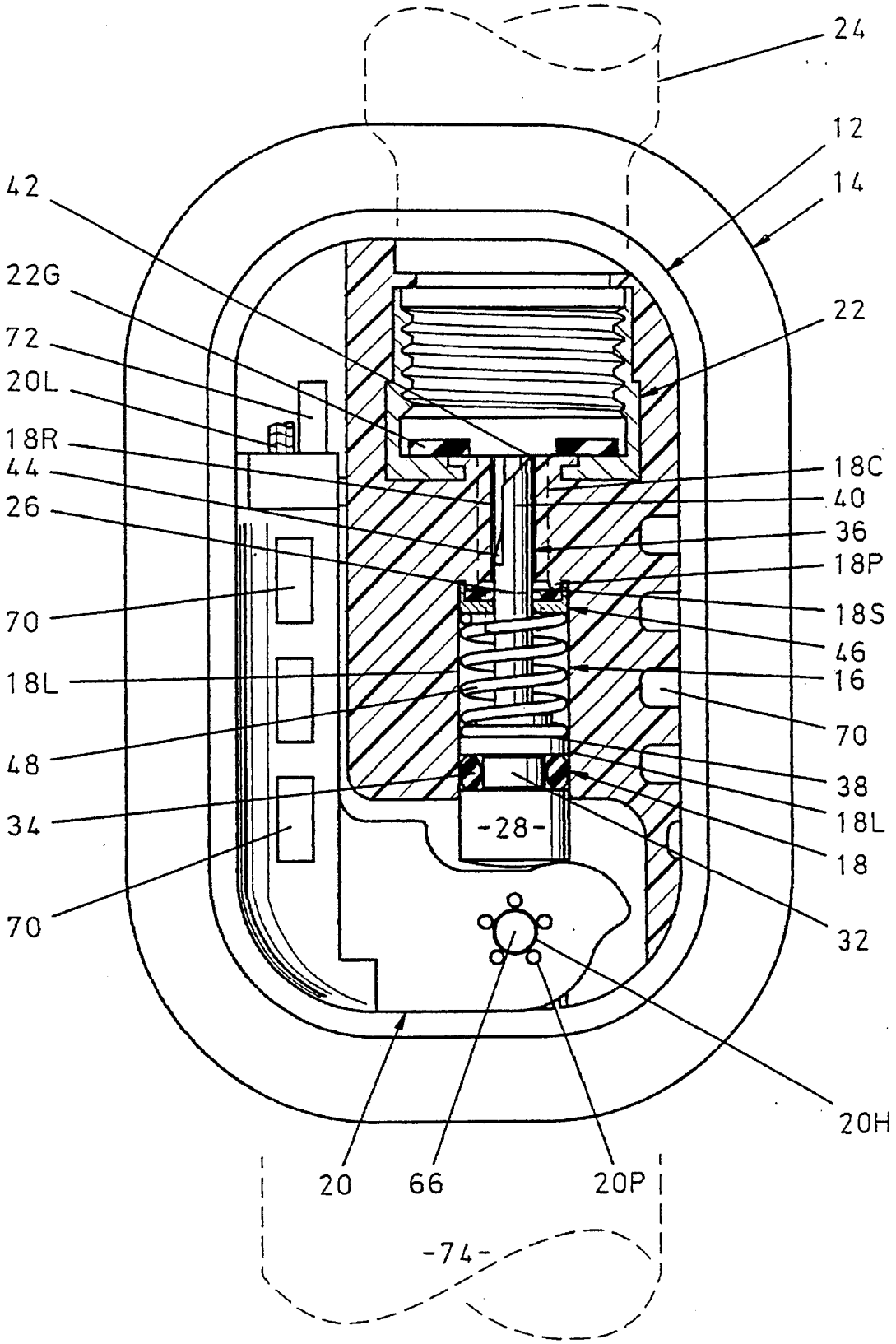
FIG. 3 is a cross-sectional view of FIG. 2 generally along lines 3—3 partially illustrating the longitudinal cross-sectional configuration of the housing with the firing lever pivotably secured therein and illustrating the firing lever in its non-fired position.
Figure 4:
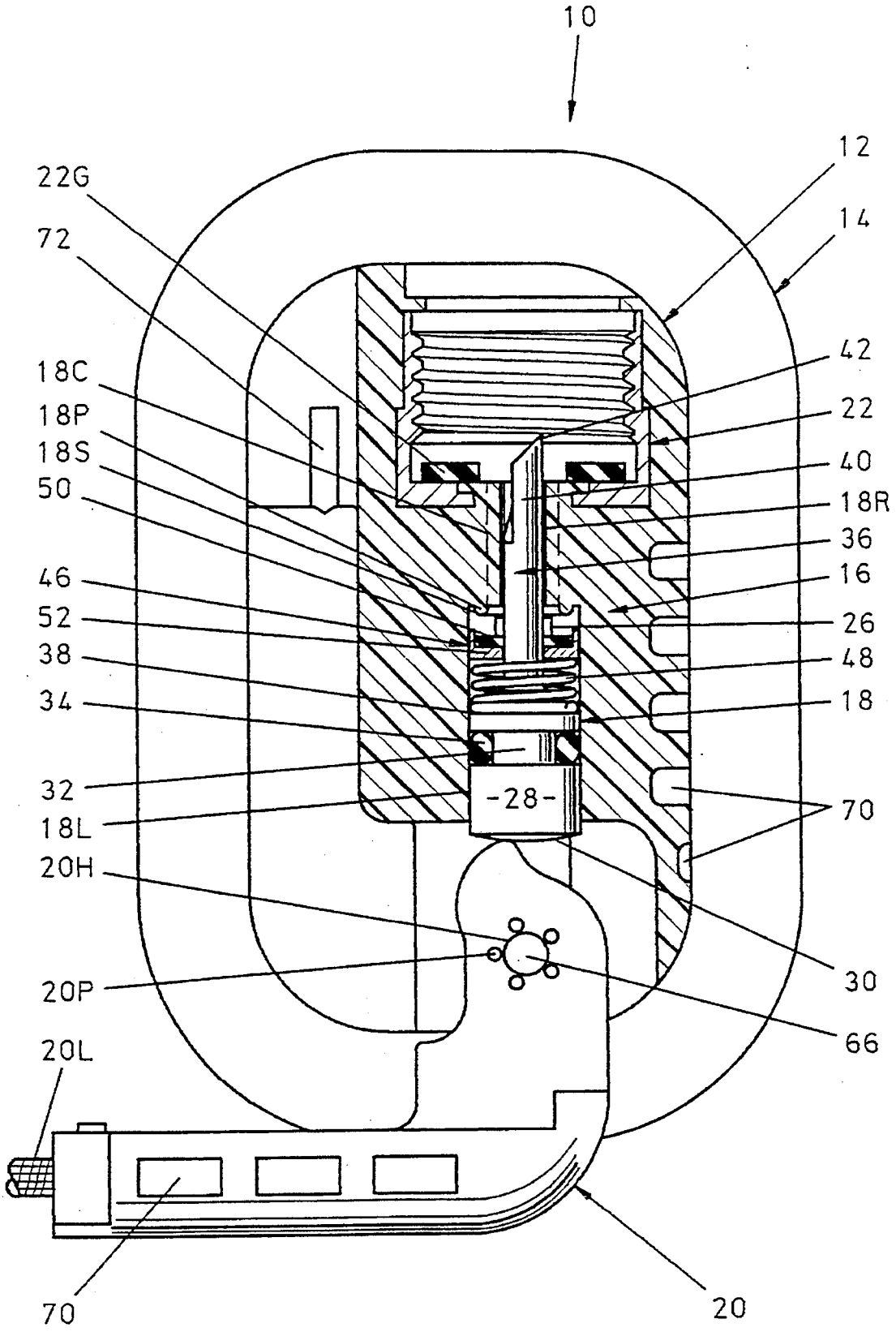
FIG. 4 is another longitudinal cross-sectional view of the inflator similar to FIG. 3, but with the firing lever illustrated in its fired position.

Referring now to FIGS. 3 and 4, a pierce pin assembly, generally indicated by numeral 16, is reciprocably mounted within a longitudinal bore, generally indicated by numeral 18, of the inflator housing 12. A firing lever, generally indicated by numeral 20, is pivotally mounted at the rearward portion of the inflator housing 12 in alignment with the pierce pin assembly 16. A lanyarded handle 20L is connected to the lever 20. A conventional metal insert 22, having interior threads and gasket 22G, is molded in situ within the forward portion of the inflator housing 12. As shown in phantom in FIG. 3, a gas cartridge 24 containing compressed gas may be threaded into the metal insert 22. Gasket 22G assures that the gas cartridge 24 is sealed within the insert 22. Finally, a bleed port 26 extends through the inflator housing 12 from the longitudinal bore 18 to the exterior of the housing 12 at the flanged side thereof such that the lead port 26 leads into the inside of the inflatable article when the inflator 12 is heat-sealed thereto.

The pierce pin assembly 16 of the invention comprises a generally cylindrical body portion 28 having a rounded rearward end 30. The body portion 28 further includes an annular slot 32 for receiving a conventional O-ring 34 that seals against the lumen 18L of the longitudinal bore 18 to preclude the escape of gas rearwardly from the bore 18.

The pierce pin assembly 16 further includes a pierce pin 36, having a generally cylindrical configuration with a diameter substantially less than the diameter of the cylindrically configured body portion 28. The pierce pin 36 extends concentrically from the forward end 38 of the body portion 28 into a reduced diameter portion 18R of the longitudinal bore 18 that includes bleed channels 18C along the length thereof.

The forward end of the pierce pin 40 is formed at an angle to define a point 42 for piercing the frangible seal of the gas cartridge 24. Further, the pierce pin 36 includes a longitudinal slot 44 that extends longitudinally along the pierce pin 36 from the point 42. Preferably, the longitudinal slot 44 extends rearwardly along the pierce pin 36 by a distance that, one the one hand, is sufficiently long to remain in the gas cartridge 24 after piercing and during movement of the pierce pin assembly 16, thereby assuring that the gas cartridge 24 can be fully spent and, on the other hand, sufficiently short not to be engaged by the sliding seal assembly 46 that otherwise could cause damage thereto.

The pierce pin assembly 16 further includes a slidable seal assembly 46 positioned about the rearward portion of the pierce pin 36. The slidable seal assembly 46 functions to permit inflation of the inflatable article and preclude deflation thereof even if the gas cartridge 24 is removed. Generally, these functions are performed by the slidable seal assembly 46 that, in its non-fired position, forms a forward seal within the longitudinal bore 18 forwardly of the bleed port 26. Upon firing, the slidable seal assembly 46 blows-back in a rearward direction along the length of the pierce pin 36 such that the forward seal is broken allowing the escaping gas from the gas cartridge 24 to bleed into the inflatable article via the bleed port 26. Once inflated, the slidable seal assembly 46 is urged forwardly by means of a compression spring 48 along the length of the pierce pin 36 to form the forward seal within the longitudinal bore 18 forwardly of the bleed port 26, thereby precluding gas within the inflatable article from escaping to the atmosphere via the bleed port 26 and longitudinal port 18.

Figure 6A:
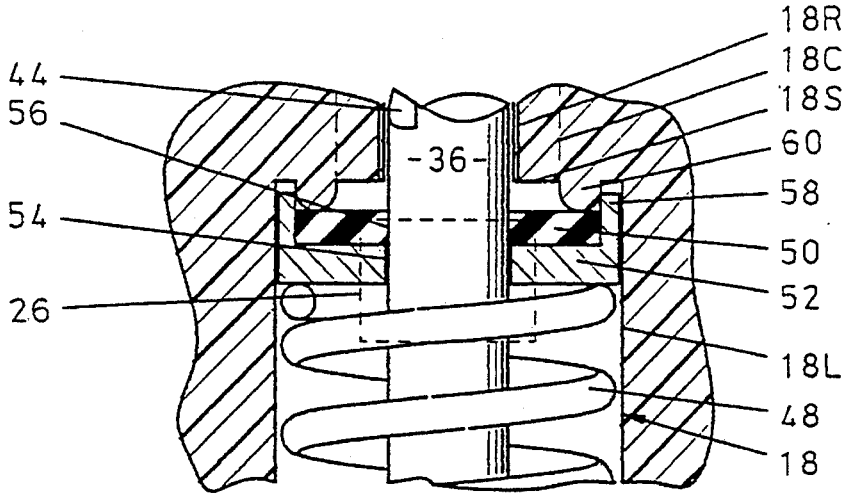
FIGS. 6A, 6B, 6C and 6D disclose alternative embodiments for the sliding seal assembly of the pierce pin assembly that each function as a check valve for allowing gas from the gas cartridge to flow into the inflatable article via the port of the inflator housing while precluding deflation thereof once inflated even if the gas cartridge is removed.

FIGS. 6A, 6B, 6C and 6D illustrate four embodiments of the slidable seal assembly 46. In the embodiment of FIG. 6A, the slidable seal assembly 46 includes a gasket 50 adhered or bonded to a rigid gasket retainer 52, both being of substantially cylindrical disk-shaped configuration and configured to be positioned within the longitudinal bore 18 of the housing 12. The rigid gasket retainer 52 includes a center hole 54 having a diameter appreciably greater than the diameter of the pierce pin 36 to permit free movement of the retainer 52 longitudinally along the length of the pierce pin 36. The gasket 50 also includes a center hole 56. However, the center hole 56 of gasket 50 includes a diameter appreciably less than the diameter of the pierce pin 36 such that an air-tight seal is formed therewith while permitting the gasket 50 to move sealingly along the length of the pierce pin 36. In addition to forming a seal about the pierce pin 36, the gasket 50 additionally forms a seal, when urged forwardly, with the step 18S formed in the longitudinal bore 18 at the juncture with the reduce diameter portion 18R of the bore 18.

As shown in the embodiment illustrated in FIG. 6A of the inflator 10, the rigid gasket retainer 52 comprises a generally disk-shaped configuration with a forwardly protruding annular rim 58 that encircles the gasket 50. Further, as shown in FIG. 6A, the step portion 18S of the bore 18 is formed with a rearwardly extending annular protrusion 60 which forms an air-tight seal with the forward surface of the gasket 50 when urged forwardly by the compression spring 48. It is noted that the annular rim 58 of the retainer 52 provides additional support for the gasket 50 to assure that the gasket does not become deformed when sealed against the annular protrusion 60 by the compression spring 48.

Figure 6B:
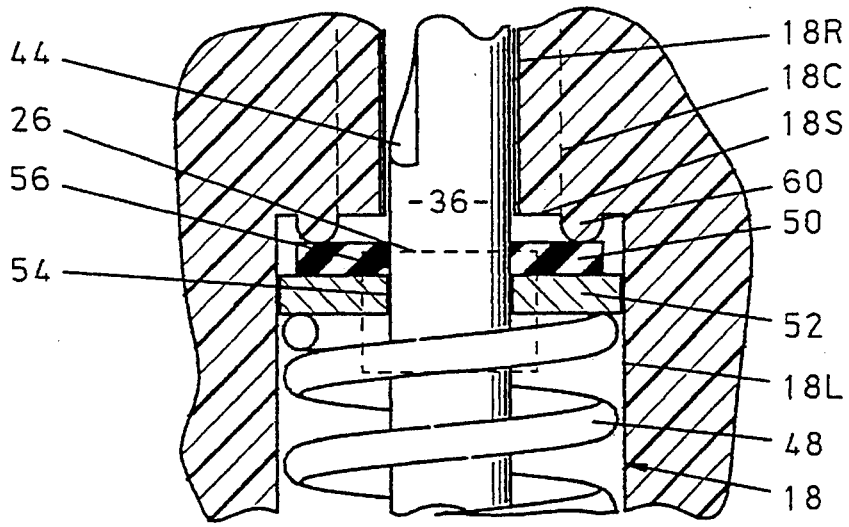

FIG. 6B illustrates another embodiment of the slidable seal assembly 46, which is substantially similar to the embodiment shown in FIG. 6A, but with a rigid gasket retainer 52 that does not include an annular rim 58. In this embodiment, it is noted that the material constituting the gasket 50 may be composed of a harder material to eliminate the need for the annular rim 58 providing the extra support.

Figure 6C:
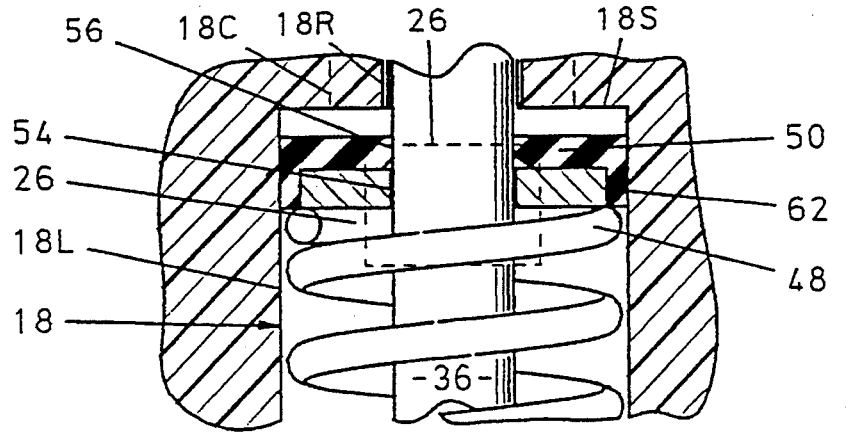

In FIG. 6C, the third embodiment of the slidable seal assembly 46 includes a similarly configured rigid gasket retainer 52 to which is adhered or bonded a gasket 50. However, in this embodiment, gasket 50 includes a rearwardly extending annular rim 62 which encircles the circumferential edge 50E of the retainer 52 and forms a seal with the lumen 18L of the longitudinal bore 18. It is noted that the gasket 50 with its annular rim 62 is adhered or bonded not only to the front surface of the retainer 52 but also, preferably, adhered or bonded to the circumferential edge 50E of the retainer 52 such that the gasket 50 and its annular rim 62 are fully supported by the retainer 52. It is also noted that the gasket 50 with its annular rim 62 is appropriately dimensioned to not only form a sliding seal with the pierce pin 36, but to also form a sliding seal with the lumen 18L of the longitudinal bore 18. In this embodiment, it is noted that the forward seal forward in the longitudinal bore 18 is not broken until the gasket 50 is blown-back to or past the port 26.

It is noted that most industry standards in the inflation art require that all seals be capable of maintaining their sealing properties from −30 degrees Fahrenheit to +160 degrees Fahrenheit. Accordingly, gasket 50 is preferably composed of a relatively low durometer material capable of maintaining its sealing properties across wide temperature extremes. Therefore, as noted above, it has been found that the gasket 50 is preferably adhered or bonded to the rigid gasket retainer 52 so that the gasket 50 retains its shape and does not fold or otherwise become deformed within the longitudinal bore 18. Notwithstanding, it is also noted that when the inflator 10 of the invention is utilized in less demanding temperature extremes, the gasket 50 may be composed of a material of sufficient durometer that it need not be adhered or bonded to the retainer 52. Indeed, it is contemplated that the need for the retainer 52 may be eliminated altogether when the gasket 50 is composed of a material (or a composite of materials) with sufficient rigidity to withstand the force of the spring 48.

Figure 6D:
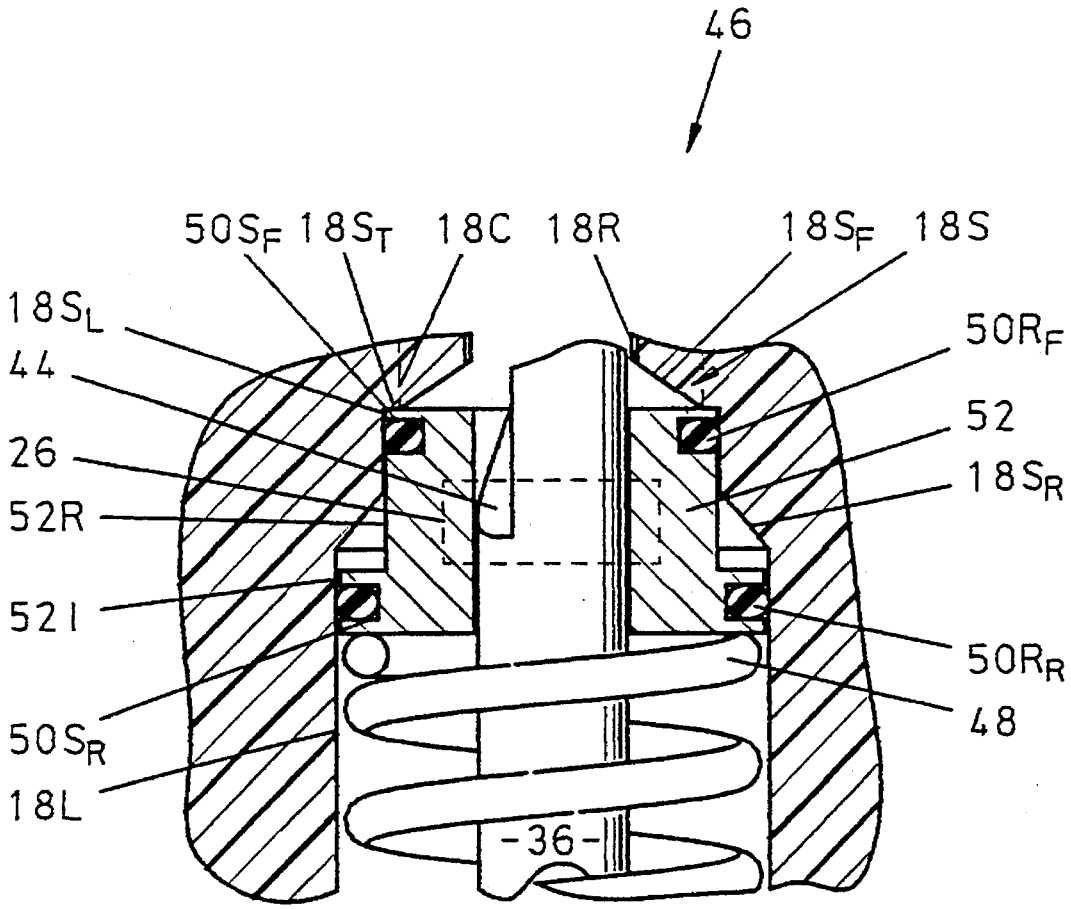

FIG. 6D illustrates the fourth embodiment of the slidable seal assembly 46. This fourth embodiment differs in principle from the three embodiments shown in FIGS. 6A, 6B and 6C in that a seal is not formed about the pierce pin 36. Rather, as shown in FIG. 6D, the slideable seal assembly 46 comprises a retainer 52 having an integrally and concentrically formed cylindrically-shaped increased diameter portion 52I and a cylindrically-shaped reduced diameter portion 52R. The increased diameter portion 52I includes a rear O-ring slot $\mathbf{50S}_R$ for receiving a conventional O-ring $\mathbf{50R}_R$. The reduced diameter portion 52R likewise includes a forward O-ring slot $\mathbf{50S}_F$ for receiving a conventional O-ring $\mathbf{50R}_F$. The O-rings $\mathbf{50R}_R$ and $\mathbf{50R}_F$ function as gaskets 50 to seal against the lumen 18L and step 18S of the bore 18. However, unlike step 18S illustrated in FIG. 6A, 6B and 6C, the step 18S in FIG. 6D is configured to include rearward and forward angled portions $\mathbf{18S}_R$ and $\mathbf{18S}_F$ with a notch formed by longitudinal portion $\mathbf{18S}_L$ and transverse portion $\mathbf{18S}_T$ positioned therebetween. The notch formed by the longitudinal and transverse portions $\mathbf{18S}_L$ and $\mathbf{18S}_T$ is dimensioned to receive the forward portion of the reduced diameter portion 52R of the retainer 52 in such a manner that the O-ring $\mathbf{50R}_F$ thereof forms a seal against the longitudinal portion $\mathbf{18S}_L$ when the retainer 52 is positioned fully forwardly.

Importantly, retainer 52 is dimensioned such that the seals formed by the O-rings $\mathbf{50R}_R$ and $\mathbf{50R}_F$ are positioned rearwardly and forwardly, respectively, of the bleed port 26 when positioned fully forward such that gas from the inflatable article is not permitted to escape therefrom in the event the gas cartridge 24 is removed.

Figure 5:
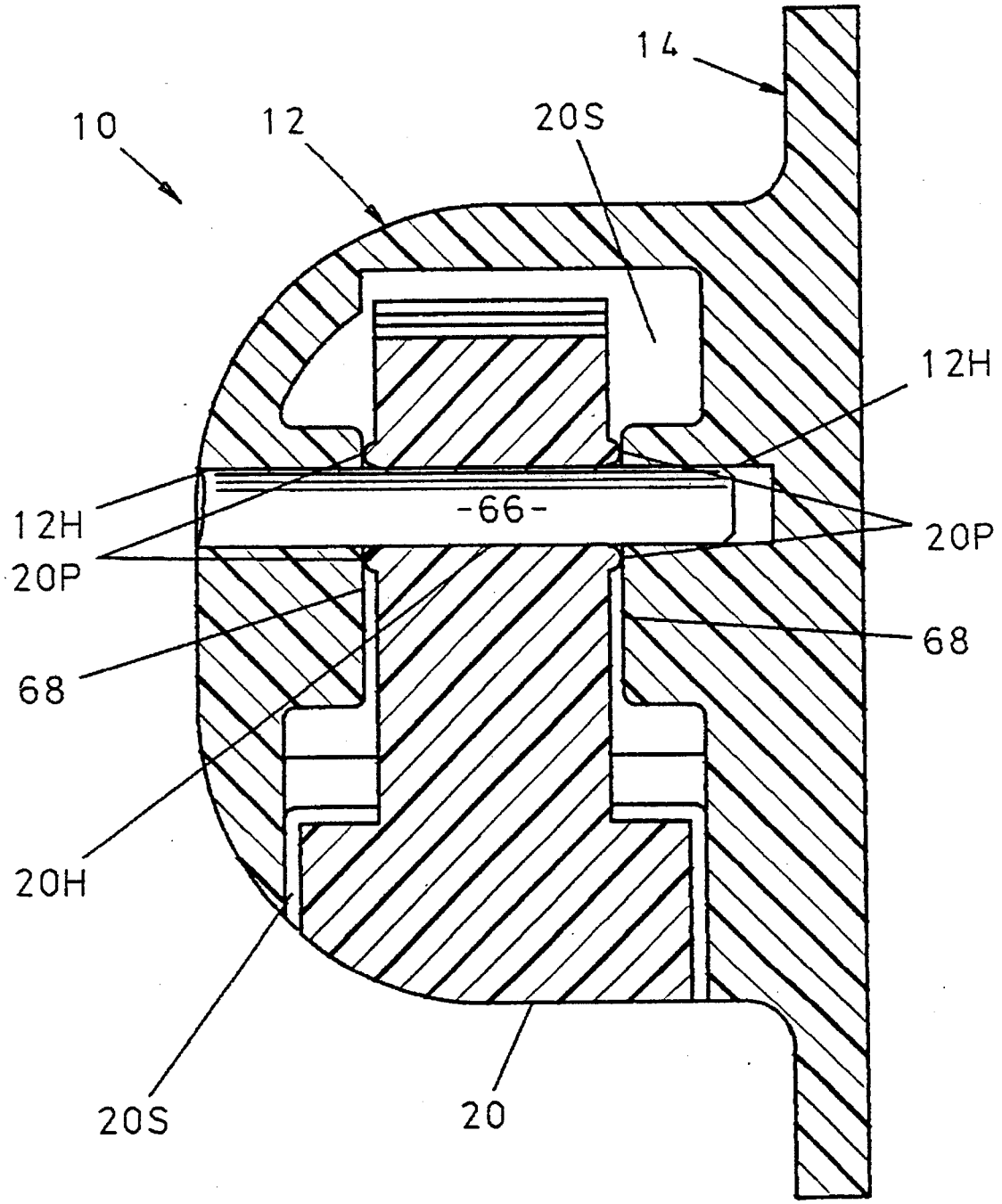
FIG. 5 is a cross-sectional view of FIG. 3 along lines 5—5 illustrating the cross-sectional configuration of a plurality of protrusions positioned about the hole in the firing lever that receives the pivot pin.

The operation of the inflator 10 of the invention is described as follows. As shown in FIG. 3, in its non-fired condition, the firing lever 20 is positioned within a slot 20S formed along the side of the inflator housing 12. Preferably, as shown in FIGS. 1, 2 and 5, the exterior surfaces of the inflator housing 12 and the firing lever 20 are formed with a smooth, aesthetically-pleasing rounded contours. As shown in FIGS. 2, 3 and 5, as is conventional in the industry, a pivot pin 66 extends into a blind hole 12H in the inflator housing 12 through a hole 20H of the firing lever 20 such that the firing lever 20 is pivotally secured in operative position for engaging the rearward end 30 of the body portion 28. However, another novel feature of the invention is the inclusion of a plurality of protrusions 20P positioned about the hole 20H, preferably equidistantly. Protrusions 20P function to provide bearing surfaces with the mating surfaces 68 of the inflator housing 12, thereby facilitating easier pivoting of the firing lever 20 with reduced friction.

As shown in FIG. 4, when the firing lever 20 is jerked to its fired position in a lanyarded handle 20L, the cammed end thereof 20E cams against the rearward end 30 of the body portion 20 of the pierce pin assembly 16, causing it to move forwardly such that its pierce pin 36 fractures the frangible seal of the gas cartridge 24. Gas flowing from the gas cartridge causes the gasket 50 and retainer 52 to blow-back against the force of the compression spring 28 at or beyond the bleed port 26, thereby causing the gas to flow through the bleed port 26 into the inflatable article. As the gas cartridge is expended, the gas pressure is reduced and the force of the compression spring 48 causes the gasket 50 and retainer 52 to move forwardly. In the embodiments shown in FIG. 6A and 6B, the gasket 50 then seals against the annular protrusion 60 of the step 18S. In the embodiment shown in FIG. 6C, gasket 50 moves forwardly past the bleed port 26 thereby sealing the bore 18 via the annular rim 62 of the gasket 50. Finally, in the embodiment shown in FIG. 6D, the forward and rearward O-rings $\mathbf{50R}_F$ and $\mathbf{50R}_R$ are positioned forwardly and rearwardly, respectively, of the bleed port 26 thereby sealing off the port 26. It is noted that in each embodiment the length of the port 26 is such that the gas cartridge 24 is almost completely expended at the point the gasket 50 moves forwardly beyond the port 26.

Notably, with regard to the embodiments in FIGS. 6A, 6B and 6C, the greater the pressure of the gas in the inflatable article, the greater force is exerted on the retainer 52 thereby increasing the sealing capabilities of the gasket 50. Also notably, in the event that the firing lever 20 is returned to its non-fired position, the pierce pin assembly 16 is returned to its non-fired position as shown in FIG. 3 with gasket 50 still maintaining its seal within the bore 18. Accordingly, the spent gas cartridge 24 may be removed without causing deflation of the inflatable article.

The above-described inflator 10 of the invention may be more economically manufactured than all known prior art inflators. With regard to manufacturing, it is noted that core-outs 70 should be provided in the inflator housing 12 to assure more accurate injection molding while reducing the quantity of injection material consumed.

Finally, as shown in FIG. 1, a pop-out (or break-away) indicator clip 72 may be provided to indicate a fired condition of the inflator 10. Additionally, as shown in phantom in FIG. 3, an automatic actuator 74 may be operatively connected to the inflator 10 to provide for automatic inflation.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An inflator for inflating an inflatable article with gas from a gas cartridge, comprising in combination:

an inflator housing including a bore;

means at one end of said bore for receiving the gas cartridge;

a pierce pin assembly reciprocatably positioned within said bore;

means at another end of said bore for actuating said pierce pin assembly to allow gas from the gas cartridge to flow into said bore;

means for fluidly connecting said bore to the inflatable article to allow the gas to inflate the inflatable article, said fluid connection means comprising a flange integrally formed about the periphery of said inflator housing, said flange being heat sealable with the inflatable article such that said inflator housing may be positioned about an aperture in the inflatable article and said flange heat sealed to the inflatable article about the aperture; and said pierce pin assembly comprising rear seal means for sealing a rearward portion of said bore and a slidable seal assembly means capable, during inflation of the inflatable article, of being blown-back by the pressure of the gas from the gas cartridge and, after inflation, forming a seal with a forward portion of said bore to prevent the gas in the inflatable article from escaping therefrom forwardly through said bore.

2. The inflator as set forth in claim 1, wherein said slidable seal assembly comprises a gasket and means for urging said gasket forwardly to form a seal with said forward portion of said bore.

3. The inflator as set forth in claim 2, wherein said gasket comprises forward and rearward O-rings positioned on a retainer for sealing forwardly and rearwardly, respectively, of said fluidly connecting means.

4. An inflator for inflating an inflatable article with gas from a gas cartridge, comprising in combination:

an inflator housing including a bore;

means at one end of said bore for receiving the gas cartridge;

a pierce pin assembly which is reciprocatably positioned within said bore;

means at another end of said bore for actuating said pierce pin assembly to allow gas from the gas cartridge to flow into said bore;

means for fluidly connecting said bore to the inflatable article to allow the gas to inflate the inflatable article; and said pierce pin assembly comprising rear seal means for sealing a rearward portion of said bore and a slidable seal assembly means capable, during inflation of the inflatable article, of being blown-back by the pressure of the gas from the gas cartridge and, after inflation, forming a seal with a forward portion of said bore to prevent the gas in the inflatable article from escaping therefrom forwardly through said bore, said slidable seal assembly comprising a gasket and means for urging said gasket forwardly to form a seal with said forward portion of said bore, said gasket being mounted onto a gasket retainer and both said gasket and said gasket retainer being positioned about a pierce pin of said pierce pin assembly such that said gasket forms a sliding seal with said pierce pin.

5. The inflator as set forth in claim 4, wherein said gasket retainer comprises a substantially disk-shaped configuration.

6. The inflator as set forth in claim 4, wherein said bore includes a protrusion for forming a seal with said gasket when urged forwardly into engagement therewith.

7. The inflator as set forth in claim 4, wherein said gasket retainer includes a rim for providing additional support to said gasket.

8. The inflator as set forth in claim 4, wherein said gasket includes an annular rim encircling the circumference of said gasket retainer that seals against the lumen of said bore.

9. An inflator for inflating an inflatable article with gas from a gas cartridge, comprising in combination:

an inflator housing including a bore;

means at one end of said bore for receiving the gas cartridge;

a pierce pin assembly reciprocatably positioned within said bore;

means at another end of said bore for actuating said pierce pin assembly to allow gas from the gas cartridge to flow into said bore, said actuator means comprising a firing lever having a pivot hole with a plurality of protrusions protruding about the circumference of said pivot hole;

said inflator including a pivot pin extending through said pivot hole and operatively connected to said housing;

means for fluidly connecting said bore to the inflatable article to allow the gas to inflate the inflatable article; and said pierce pin assembly comprising rear seal means for sealing a rearward portion of said bore and a slidable seal assembly means capable, during inflation of the inflatable article, of being blown-back by the pressure of the gas from the gas cartridge and, after inflation, forming a seal with a forward portion of said bore to prevent the gas in the inflatable article from escaping therefrom forwardly through said bore.

10. A method for inflating an inflatable article with gas from a gas cartridge, comprising the steps of:

providing an inflator housing including a flange formed integrally about the periphery of the housing and composed of a material that is heat sealable with the inflatable article, the inflator housing also including a bore;

receiving the gas cartridge at one end of the bore;

reciprocatably positioning a pierce pin assembly within the bore;

actuating the pierce pin assembly to allow gas from the gas cartridge to flow into the bore;

heat sealing the flange about an aperture in the inflatable article to fluidly connect the bore to the inflatable article to allow the gas to inflate the inflatable article; and sealing a rearward portion of the bore and, after inflation, forming a seal with a forward portion of the bore to prevent the gas in the inflatable article from escaping therefrom forwardly through the bore.

11. The method as set forth in claim 10, wherein the step of forming a seal with a forward portion of the bore comprises providing a gasket and urging the gasket forwardly to form a seal with the forward portion of the bore.

12. The method as set forth in claim 11, wherein the step of forming a seal with a forward portion of the bore includes the step of providing gasket retainer and mounting the gasket to the gasket retainer.

13. The method as set forth in claim 12, further including the step of positioning the gasket and the gasket retainer onto a pierce pin to form a sliding seal with the pierce pin.

14. The method as set forth in claim 12, further including the step of positioning a first portion and a second portion of the gasket forwardly and rearwardly, respectively, of the fluidly connecting means.

* * * * *